US006637357B2

(12) United States Patent
Choi

(10) Patent No.: US 6,637,357 B2
(45) Date of Patent: Oct. 28, 2003

(54) OVERLOCK SEWING MACHINE

(75) Inventor: Hin Fai Choi, East Brunswick, NJ (US)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/122,626

(22) Filed: Apr. 15, 2002

(65) Prior Publication Data

US 2002/0157585 A1 Oct. 31, 2002

(30) Foreign Application Priority Data

Apr. 17, 2001 (JP) ..... 2001-117806

(51) Int. Cl.[7] ..... D05B 1/08; D05B 29/02; D05B 65/00

(52) U.S. Cl. ..... 112/162; 112/165; 112/237; 112/288

(58) Field of Search ..... 112/162, 163, 112/165, 197, 235, 237, 238, 239, 288, 172, 475.17, 475.26

(56) References Cited

U.S. PATENT DOCUMENTS 4,356,782 A * 11/1982 Ueyama et al. ..... 112/197
5,123,365 A * 6/1992 Ichimura ..... 112/165
5,495,817 A * 3/1996 Zeigler et al. ..... 112/217.3
6,070,540 A * 6/2000 Nomura et al. ..... 112/68

FOREIGN PATENT DOCUMENTS

JP 2-30277 7/1990

* cited by examiner

*Primary Examiner*—Ismael Izaguirre
(74) *Attorney, Agent, or Firm*—Flynn, Thiel, Boutell & Tanis, P.C.

(57) ABSTRACT

A two-needle overlock sewing machine comprises a throat plate and a middle tongue. The throat plate has an opening needle hole and an outer tongue. The middle tongue is disposed parallel to the outer tongue, a thread chain is formed so as to envelop both tongues. The presser foot is disposed so as to press the cloth to the throat plate by a spring. A push-up lever lifts up the presser foot by handling. The push-up lever and the middle tongue are coupled together by a transmission mechanism. By raising the presser foot by manipulation of the push-up lever at the finish of sewing operation, the middle tongue draws back simultaneously and retreats from the needle hole. As a result, the manipulation for drawing back the middle tongue during the process of thread chain handling is not needed, and the operation is simplified.

4 Claims, 7 Drawing Sheets

OVERLOCK SEWING MACHINE

BACKGROUND OF THE INVENTION

The present invention relates to an overlock sewing machine, and more particularly to a two-needle overlock sewing machine capable of sewing a thread chain into a seam.

An overlock sewing machine of this kind was proposed, for example, in Japanese Patent Publication No. 2-30277, in which a middle tongue is projected into a needle hole or drawn back into a needle hole by using a manual operation mechanism. An outer tongue is formed in the cloth feed direction as part of a throat plate, and the middle tongue is parallel to the outer tongue, and is slidably mounted on the throat plate. Before the throat plate, a thread chain holder is disposed, and the thread chain holder is designed to cut off and hold the thread chain. The outer tongue forms part of an opening needle hole.

In this kind of sewing machine, in the sewing process, while the middle tongue is supporting the cloth on the needle hole, a stitch is formed while enveloping the outer tongue and middle tongue. When the end of the cloth passes through the middle tongue and outer tongue, the thread chain is formed on the middle tongue and outer tongue. After the sewing process, a presser foot is raised by manipulation of a push-up lever, and then the middle tongue is drawn backward from the needle hole by manipulation of the manual operation mechanism to pull out the middle tongue from the thread chain. Afterwards, the sewn cloth is pulled out to the cloth feed-out side, and the thread chain consecutive to the cloth is pulled out from the outer tongue. The cloth is then turned to the front side and pulled up, and the thread chain consecutive to the cloth end is inserted into the thread chain holder, and thereby the thread chain is cut off and held at the same time.

In handling the thread chain, as mentioned above, the middle tongue must be drawn back from the needle hole by manipulation of the manual operation mechanism. Since the manual operation mechanism must be manipulated, the cloth could not be handled continuously by both hands. Besides, a control device is needed to move back and forth the middle tongue at a proper timing by using a solenoid or the like, the structure is complicated and the cost is increased.

SUMMARY OF THE INVENTION

It is hence an object of the invention to present a two-needle overlock sewing machine capable of simplifying the mechanism for moving back and forth the middle tongue and processing the thread chain after sewing without sacrificing the handling performance of the cloth.

The two-needle overlock sewing machine of the present invention comprises a throat plate, a thread chain holder, a presser foot, spring means, a push-up lever, and a middle tongue. The throat plate includes an opening needle hole, and an outer tongue projecting in the cloth feed direction to compose one side of the needle hole. The thread chain holder is disposed before the throat plate, and is designed to cut off and hold the thread chain. The presser foot is disposed above the throat plate, and the spring means presses the presser foot to the throat plate. The push-up lever lifts up the presser foot from than the throat plate against the action of the spring means. The middle tongue is fitted to the throat plate so as to be movable back and forth in the cloth feed direction. The middle tongue is coupled with the push-up lever by way of a transmission mechanism, and is designed to project into the needle hole in forward motion, and be drawn back from the needle hole in backward motion. That is, when the presser foot is raised by manipulating the push-up lever, the middle tongue is drawn back to retreat from the needle hole.

According to the present invention, after sewing operation, when the presser foot is raised by manipulating the push-up lever, the middle tongue simultaneously retreats from the needle hole, and is pulled out from the thread chain consecutive to the cloth end. It hence omits the manipulation for moving back the middle tongue after raising the presser foot. Therefore, the cloth can be handled by both hands, and the cloth handling performance is enhanced. The transmission mechanism for coupling the push-up lever and middle tongue is only required to have a function of transmitting the motion of the push-up lever to the middle tongue, and does not require solenoid or control device needed when manipulating the middle tongue independently. As a result, the structure is simplified and the cost is lowered.

Preferably, the transmission mechanism is composed of a link mechanism coupled to the middle tongue, a bell crank lever having an intermediate part, for example, rotatably supported on a sewing machine frame, and wire means for coupling the link mechanism and push-up lever. By using the wire means in the transmission mechanism, the structure becomes simpler and the cost is further reduced.

More preferably, the middle tongue is forced in a forward moving direction by the spring, and the wire means and the push-up lever are coupled by the link. The link and push-up lever are coupled together as a slot is formed at either side and a stepped screw is driven in the other through the slot.

In the present invention, by manipulating the push-up lever and raising the presser foot against the action of the spring means, the middle tongue begins to move backward on the way. That is, by manipulating the push-up lever, the stepped screw moves within the slot. When the push-up lever is further manipulated until the stepped screw reaches the end of the slot, the wire means is pulled thereafter, and the middle tongue moves back against the action of the spring, and retreats from the needle hole. Therefore, according to the present invention, while sewing a cloth having a stepped portion, if the presser foot rides over the stepped portion and climbs somewhat, the middle tongue continues to support the cloth in the sewing process in the needle hole without drawing back.

Further preferably, the presser foot and push-up lever compose part of a pressing mechanism, and the pressing mechanism comprises a pivot shaft turnably supported on a sewing machine frame, a presser base elevating in conjunction with the turn of the pivot shaft, with the presser foot fitted at its leading end, and a lever supported rotatably about the pivot shaft for rotating about the pivot shaft in conjunction with the push-up lever, and a rigger part of the pivot shaft and a latch part of the lever are engaged with each other so as to be able to depart in the rotating direction.

In the present invention, similarly, when the presser foot rides over the stepped portion of the cloth, the rigger part of the pivot shaft and the latch part of the lever depart from each other, so that the middle tongue maintains a state projecting into the needle hole.

Other objects and features of the present invention will be more clearly understood from the following explanation about an embodiment taken in conjunction with the accompanying drawings.

DESCRIPTION OF THE PREFERRED EMBODIMENT

Figure 1:
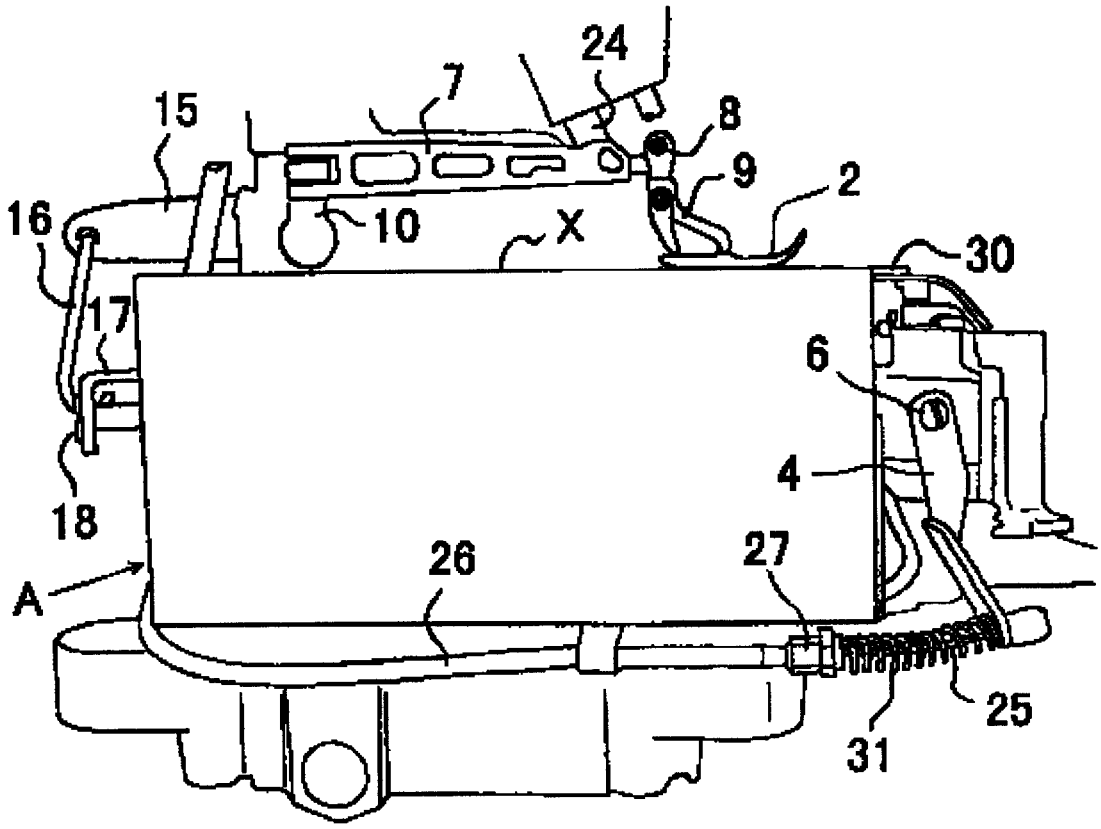
FIG. 1 is a side view showing essential parts of a two-needle overlock sewing machine according to the present invention.
Figure 7:
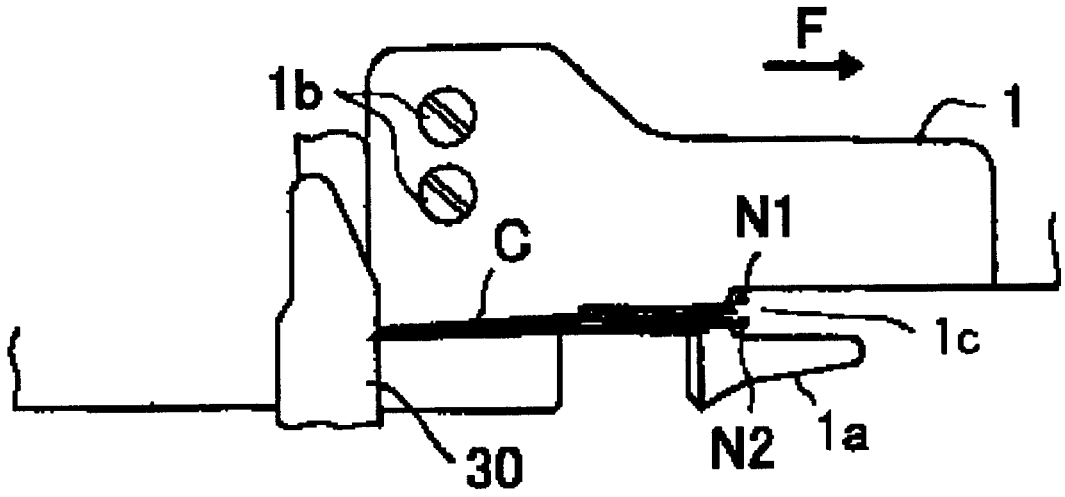
FIG. 7 is a diagram showing a thread chain held in a thread chain holder.
Figure 8:
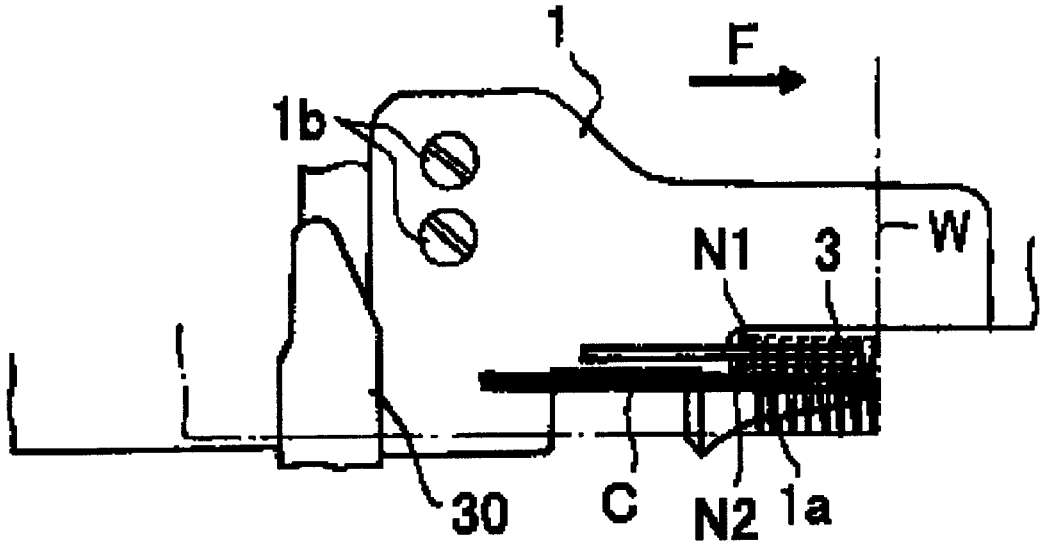
FIG. 8 is a diagram showing a mode of forming of a seam while enveloping the outer tongue and middle tongue in the sewing process.

FIG. 1 is a side view showing essential parts of a two-needle overlock sewing machine according to the present invention. A working plane X has a throat plate 1. This throat plate 1 has, as shown in FIG. 7 and FIG. 8, an outer tongue 1*a* forming one side of an opening needle hole 5, and a long groove (not shown) for a feed dog. The throat plate 1 is fixed to a sewing machine frame A with screws 1*b*, and an outer tongue 1*a* project in the cloth feed direction. A middle tongue 3 disposed parallel to the outer tongue 1*a* is fitted to the throat plate 1 so as to be movable back and forth in the cloth feed direction. This middle tongue 3 moves forward, and projects into an opening needle hole 1*c*, or moves backward to retreat from the needle hole 1*c*.

Figure 2:
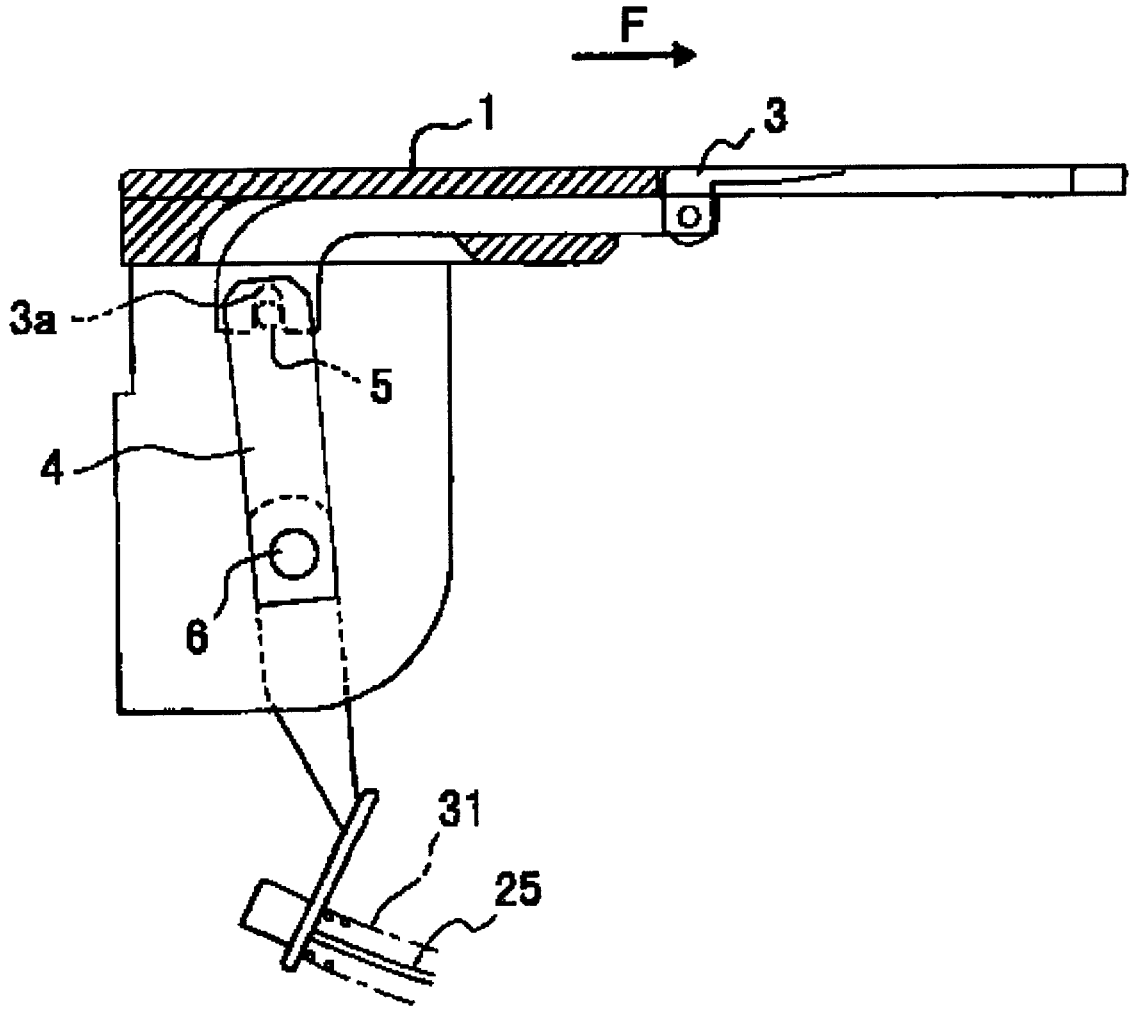
FIG. 2 is a side view showing a middle tongue, and a part of transmission mechanism for moving back and forth the middle tongue.

The motion of the middle tongue 3 is executed through a transmission mechanism by manipulation of push-up lever, and part of this transmission mechanism is shown in FIG. 2. In FIG. 2, a base end portion 3*a* of the middle tongue 3 is shape like a fork, and a pin 5 at the upper end of a bell crank lever 4 is fitted. The bell crank lever 4 has its intermediate part rotatably supported on a sewing machine frame by a horizontal shaft 6, while the lower end is coupled to the push-up lever mentioned below by way of a wire 25.

Figure 3:
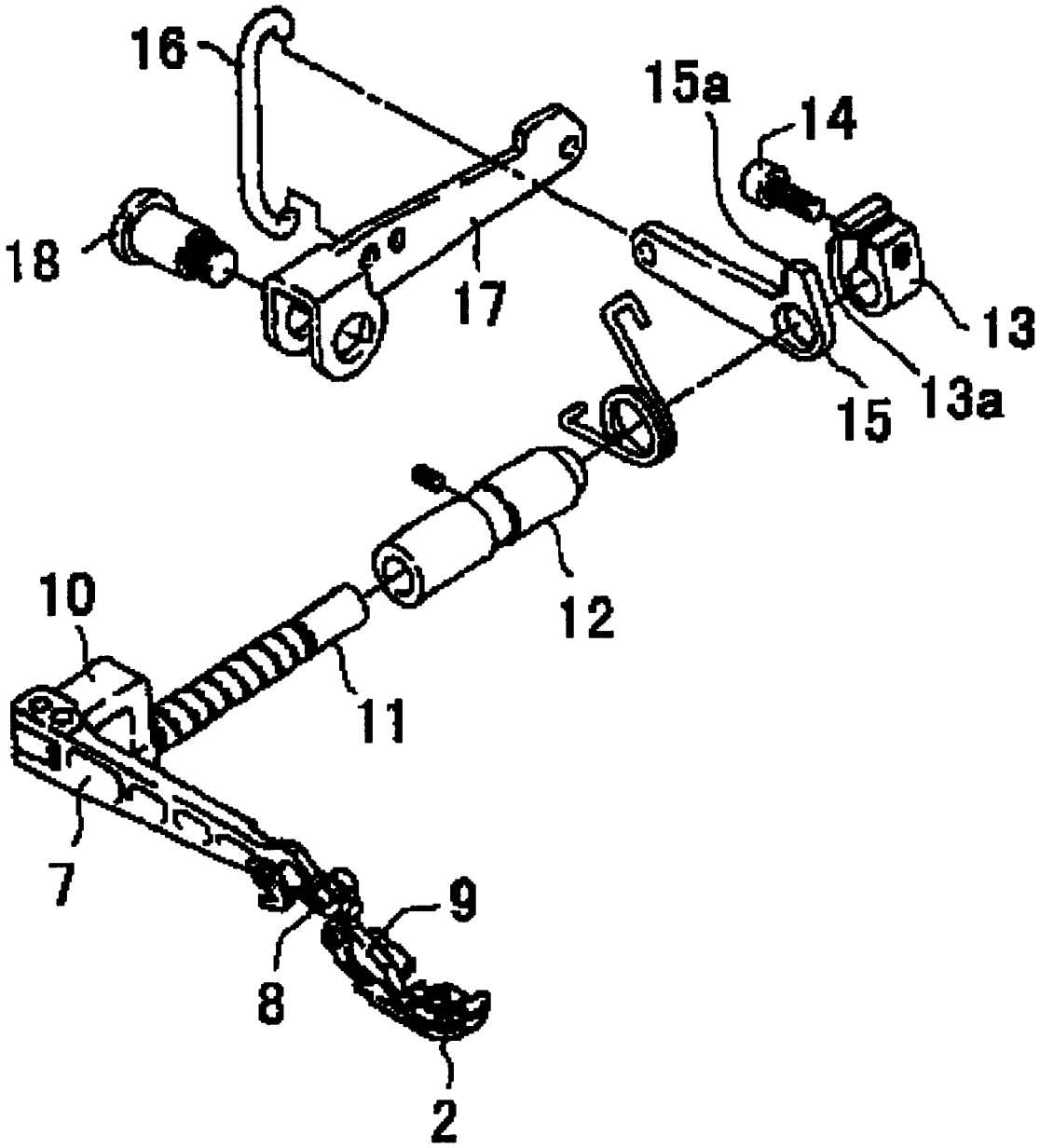
FIG. 3 is a perspective exploded view of a pressing mechanism of the sewing machine.

FIG. 3 shows a pressing mechanism of a presser foot 2, and the presser foot 2 is attached to a pressing holder 9 being fixed to the leading end of a presser base 7 with screws 8. The presser base 7 is coupled to a crank arm 10 affixed to a pivot shaft 11 so as to be free to swivel in the horizontal direction, so that the presser foot 2 may be set aside to the throat plate side.

Figure 4:
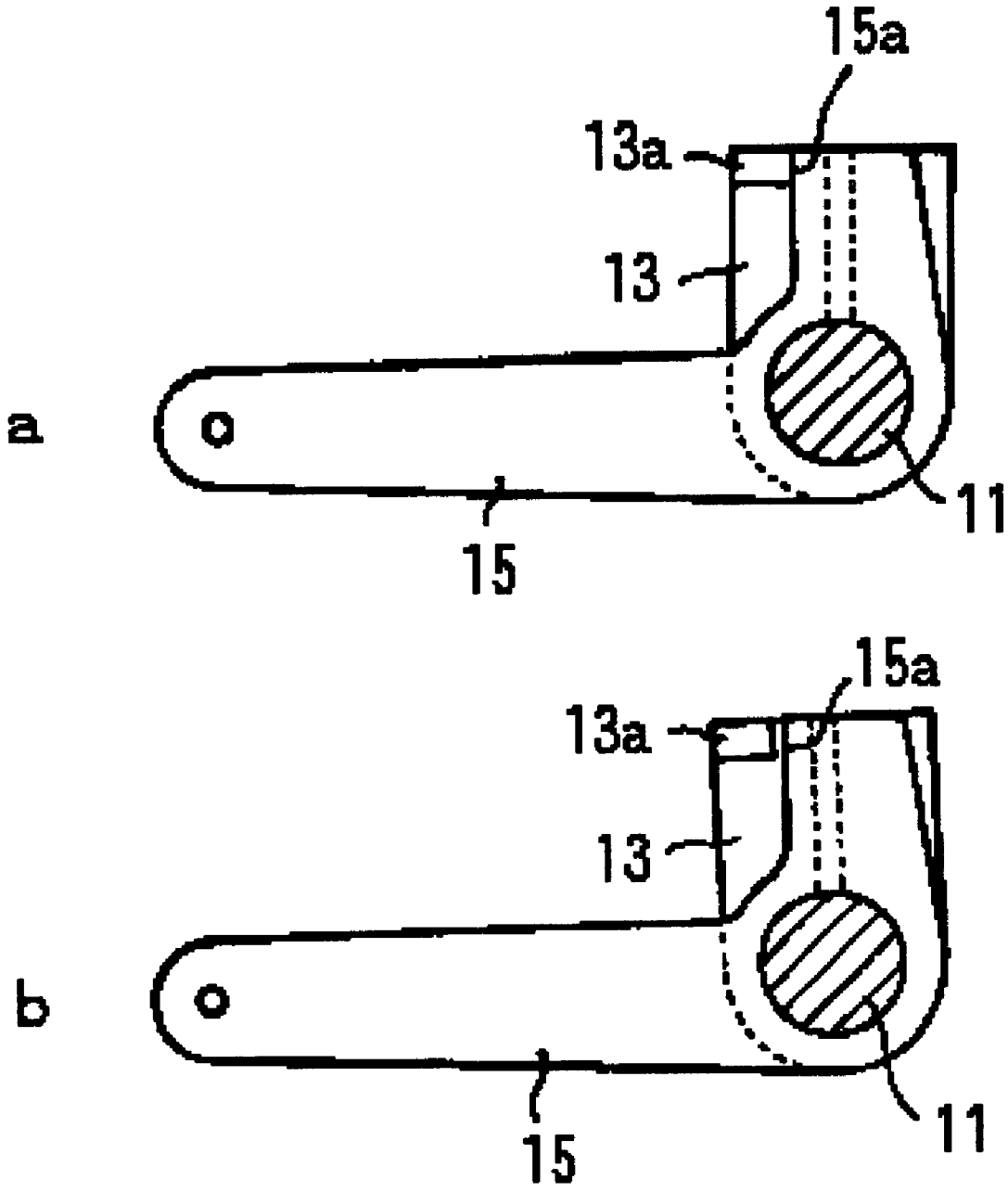
FIG. 4 is a side view showing the relation of lever of pressing mechanism and collar affixed to a pivot shaft in the sewing machine shown in FIG. 3.

The pivot shaft 11 is passed through a sleeve 12 fitted on the sewing machine frame, and is supported rotatably. A collar 13 is fitted to one end of the pivot shaft 11 with screws 14, and this collar 13 rotates together with the pivot shaft 11. A lever 15 is fitted rotatably to the pivot shaft 11, and as shown in FIG. 4, a latch part 15*a* of the lever 15 and a rigger part 13*a* of the collar 13 are engaged with each other so as to be able to depart from the side surface.

The lever 15 is coupled to a push-up lever 17 through a coupling lever 16. The push-up lever 17 is rotatably supported on the rear side of the sewing machine frame A with a stepped screw 18, and is manipulated in the vertical direction by means of a tread pedal or the like.

Figure 5:
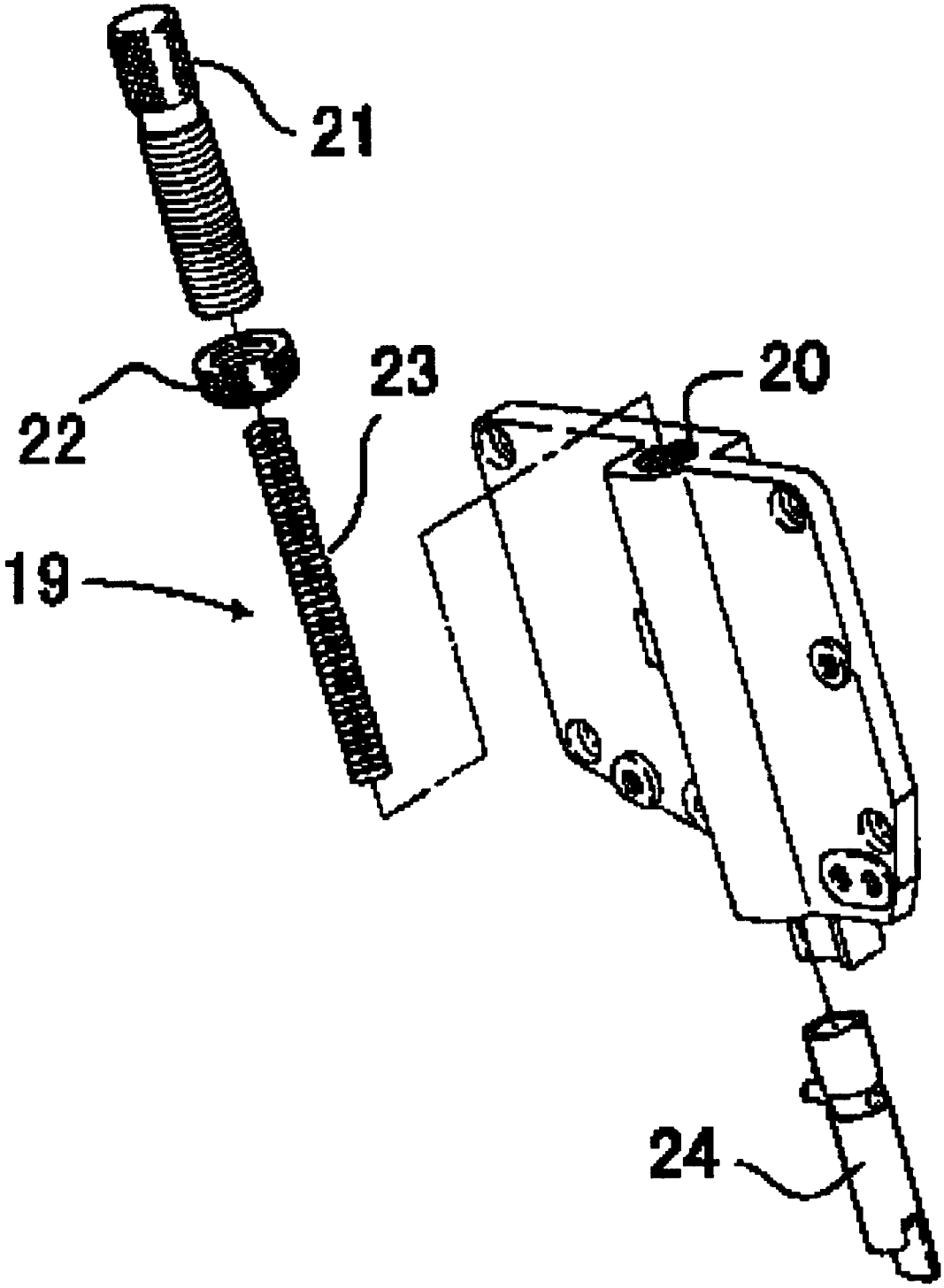
FIG. 5 is a perspective exploded view of spring means for pressing the presser foot to the throat plate.
Figure 6:
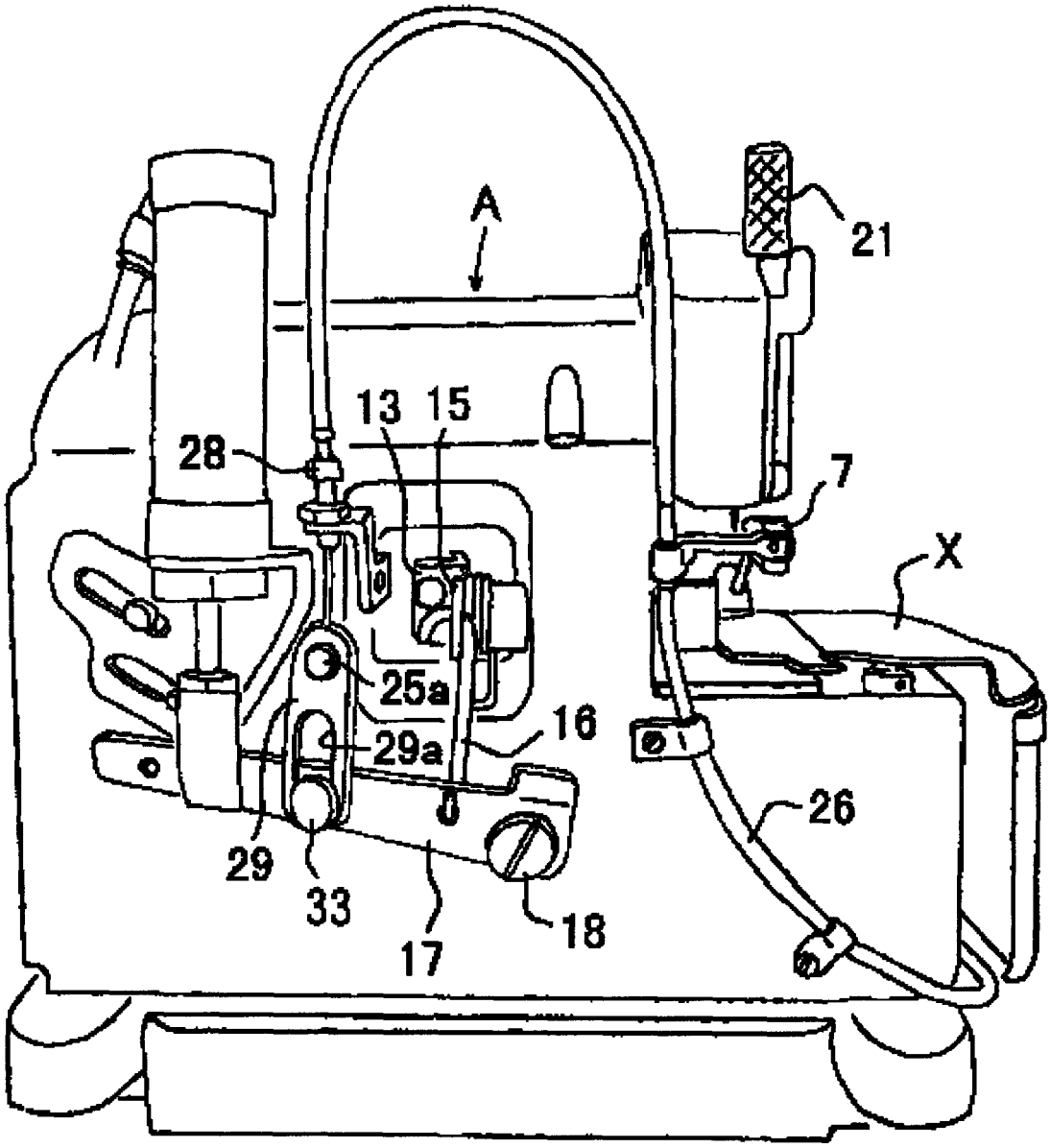
FIG. 6 is a rear view of the overlock sewing machine shown in FIG. 1.

Spring means 19 for pressing the presser foot 2 to the throat plate 1, as shown in FIG. 5, comprises a spring 23 and an adjusting screw 21. The spring 23 inserts into a tubular sleeve 20 formed in the head of the sewing machine frame A. The adjusting screw 21 is put in the upper part of the tubular sleeve 20 so as to press the spring 23. The adjusting screw 21 is turned by loosening a locking screw 22, and is designed to adjust the vertical position. The spring 23 inserted in the tubular sleeve 20 pushes down the pressing base 7 through a rod 24, so that the presser foot 2 is pressed against the throat plate 1.

A wire 25 is for coupling the bell crank lever 4 and the push-up lever 17. The wire 25 is inserted in a tube 26, and the tube 26 is connected to a connecting piece 27 fixed at a side of the sewing machine frame A, and a connecting piece 28 fixed to the rear side of the sewing machine frame A. A compression spring 31 is loaded in the wire 25 between the connecting piece 27 and bell crank lever 4, and the bell crank lever 4 is forced to rotate in the clockwise direction in FIG. 2, and usually the middle tongue 3 projects into the needle hole. The wire 25 passing through the tube 26 is coupled to a link 29 at a drum 25*a*. As a result, the bell crank lever 4 is coupled by a stepped screw 33 affixed to the push-up lever 17 through a slot 29*a*. Within the range of the slot 29*a*, the wire 25 is allowed to slide in the tube 26 without moving the push-up lever 17.

A thread chain holding and cutting device 30 is disposed before the throat plate 1, and cuts off a thread chain consecutive to the cloth. Although not shown, when the push-up lever 17 and the tension releasing member of the tension device are coupled actively so as to release the thread tension of the tension device at manipulating the push-up lever 17, the thread chain consecutive to the cloth may be easily pulled out of the outer tongue 1*a*.

The operation of the two-needle overlock sewing machine having such configuration is explained below.

During sewing operation, the push-up lever 17 is not manipulated, and the presser foot 2 is pressed against the throat plate 1 by the action of the spring 23 for pressing down the presser base 7. Therefore, the leading end of the middle tongue 3 projects into the needle hole 1*c* of the throat plate 1 as shown in FIG. 8. The leading end of the middle tongue 3 is supporting from beneath the cloth W which is inclined to fall into the needle hole 1*c* along with descent of the needles at needle locations N1, N2. During sewing operation, by collaboration of two needles and looper not shown, overedge stitches is formed at the edge of the cloth W so as to envelop the outer tongue 1*a* and middle tongue 3.

Then the cloth end is released from the both tongues 1*a*, 3 and sent out. When the sewing operation is over, the operator manipulates the push-up lever 17 by a tread pedal or the like. As a result, the middle tongue 3 draws back, and its leading portion retreats from the needle hole 1*c*, and is pulled out of the thread chain C consecutive to the cloth.

Next, the operator pulls out the cloth W to the feed-out side, and draws out the base end of the thread chain from the outer tongue 1*a*. Then the cloth is turned on the working plane X and pulled up to the front side of the throat plate 1. At this time, since the middle tongue 3 retreats from the needle hole as mentioned above, the thread chain C consecutive to the cloth can move without being supporting by the middle tongue 3. The thread chain C consecutive to the cloth is inserted into the thread chain holding and cutting device 30 disposed before the throat plate 1, and is cut off, and a cut thread chain remaining in a side of sewing machine is held at that place (FIG. 7).

Consequently, when the cloth is set on the working plane X, and the presser foot 2 is pressed against the throat plate 1 by manipulation of the push-up lever 17, simultaneously, the leading end of the middle tongue 3 projects into the needle hole 1*c*, the cloth W on the needle hole is supported from beneath same as during sewing operation (FIG. 8).

When sewing a cloth having a stepped portion, the presser foot 2 is lifted slightly by the stepped portion, and the collar 13 also turns somewhat in the counterclockwise direction in FIG. 4*a*. At this time, as shown in FIG. 4*b*, only the rigger part 13*a* departs from the latch part 15*a* of the lever 15, and the push-up lever 17 is not moved. That is, the link 29 coupled to the wire 25 remains in a state being lifted by the compression spring 31, and hence the leading end of the middle tongue 3 does not move back from the needle hole 1*c*. Therefore, if there is a stepped portion in the cloth W, sewing by making use of the middle tongue 3 can be done without any problem.

What is claimed is:

1. A two-needle overlock sewing machine comprising a throat plate including an opening needle hole, and an outer tongue projecting in the cloth feed direction to form one side of the needle hole, a thread chain holder for cutting off and holding a thread chain, said thread chain holder being disposed before the throat plate, a presser foot disposed above the throat plate, spring means for pressing the presser foot to the throat plate, a push-up lever for lifting up the presser foot from the throat plate against the action of the spring means, and a middle tongue disposed in the throat plate so as to be movable back and forth in the cloth feed direction, said middle tongue being projected into the needle hole in forward motion, and being retreated from the needle hole in backward motion, wherein: the middle tongue is coupled with the push-up lever through a transmission mechanism, and when the presser foot is raised by manipulating the push-up lever, the middle tongue is drawn back to retreat from the needle hole.

2. A two-needle overlock sewing machine as defined in claim 1, wherein said transmission mechanism is composed of a link mechanism, and wire means for coupling the link mechanism and push-up lever.

3. A two-needle overlock sewing machine as defined in claim 2, wherein said middle tongue is forced in a forward moving direction by a spring, said wire means and push-up lever are coupled through a link, the link and the push-up lever are coupled together as a slot is formed at either side and a stepped screw is driven in the other through the slot.

4. A two-needle overlock sewing machine as defined in claim 1, wherein said presser foot and push-up lever compose part of a pressing mechanism, and said pressing mechanism comprises a pivot shaft turnably supported on a sewing machine frame, a presser base elevating in cooperation with the rotation of the pivot shaft, said presser base being fitted the presser foot at its leading end, and a lever supported rotatably about the pivot shaft for rotating about the pivot shaft in conjunction with the push-up lever, and a rigger part of the pivot shaft and a latch part of the lever are engaged with each other so as to be able to depart in the rotating direction.

* * * * *